US006306047B1

(12) United States Patent
Kusumoto

(10) Patent No.: US 6,306,047 B1
(45) **Date of Patent: *Oct. 23, 2001**

(54) GOLF CLUB SHAFT

(75) Inventor: Harunobu Kusumoto, Saitama (JP)

(73) Assignee: Daiwa Seiko, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/104,444

(22) Filed: Jun. 25, 1998

(30) Foreign Application Priority Data

Jun. 26, 1997 (JP) ..... 9-170292
Feb. 27, 1998 (JP) ..... 10-048185

(51) Int. Cl.[7] ..... A63B 53/10
(52) U.S. Cl. ..... 473/319; 428/36.3
(58) Field of Search ..... 473/316–323; 428/363, 36.9; 264/635; 156/187, 188

(56) References Cited

U.S. PATENT DOCUMENTS 4,757,997 * 7/1988 Roy ..... 473/319
5,028,464 * 7/1991 Shigetoh ..... 428/35.9
5,093,162 * 3/1992 Fenton ..... 428/34.5
5,156,396 * 10/1992 Akatsuka ..... 473/319
5,231,783 * 8/1993 Utsuno .
5,421,573 * 6/1995 Kawamatsu ..... 473/319
5,601,892 * 2/1997 McIntosh ..... 428/35.8
5,634,861 * 6/1997 Yamamoto ..... 473/319
5,721,030 * 2/1998 Okada .
5,924,936 * 7/1999 Penley ..... 473/319

* cited by examiner

*Primary Examiner*—Jeanette Chapman
*Assistant Examiner*—Stephen L. Blau
(74) *Attorney, Agent, or Firm*—Liniak, Berenato, Longacre & White

(57) ABSTRACT

A golf club includes a shaft having prepreg sheets wound thereon, each of the prepreg sheets being formed by orienting reinforcing fibers in one direction and then by impregnating the fibers with a synthetic resin. The shaft includes an oblique fiber layer formed by winding the prepreg sheets 7*a* and 7*b*, each having the reinforcing fibers oriented in a direction oblique relative to an axis of the shaft, in such a superposed manner that the directions of orientation of the reinforcing fibers of the prepreg sheets cross each other, and a thickness of each of the prepreg sheets 7*a* and 7*b*, constituting the oblique fiber layer, is not more than 0.06 mm.

5 Claims, 4 Drawing Sheets

GOLF CLUB SHAFT

BACKGROUND OF THE INVENTION

1. Field of the Invention

This invention relates to a golf club shaft.

2. Description of the Related Art

Generally, a shaft, used in a golf club, is produced by a method in which so-called prepreg sheets, each formed by arranging or orienting reinforcing fibers in one direction and then by impregnating these fibers with a synthetic resin, are wound in a superposed manner on a metal core, and then a cellophane tape is wound on this layer structure, and then the synthetic resin is thermally set or cured in a heating furnace, and then this product is cooled, and then the metal core and the cellophane tape are removed from this product, and then this product is subjected to other steps such as grinding and coating, thereby producing the golf club shaft.

Generally, the laminate structure, formed by the prepreg sheets wound on the metal core, comprises a body layer which comprises an oblique fiber layer formed by the prepreg sheets (that is, the oblique prepreg sheets having the reinforcing fibers oriented (that is, arranged to extend) in a direction oblique relative to the axis of the metal core (usually, at an angle of 45° relative to the axial direction) ) wound in such a superposed manner that the direction of orientation of the fibers of the these prepreg sheets cross each other (usually at angles of ±45° relative to the axial direction), and an axial fiber layer formed by the prepreg sheet (that is, the axial prepreg sheet having the reinforcing fibers oriented in the direction of the axis of the metal core). Further, reinforcing layers, formed respectively by an axial prepreg sheet and a peripheral prepreg sheet (having the reinforcing fibers oriented in a peripheral or circumferential direction), are provided at necessary portions of the body layer.

In the above construction, the oblique sheets and the axial sheet, used in the body layer, usually have a thickness of about 0.1 mm to about 0.2 mm.

However, as described above, the oblique sheets are wound on the metal core in such a superposed manner that the directions of orientation of the fibers of these sheets cross or intersect each other, and therefore the combined thickness of the oblique sheets are about twice larger than the thickness of the axial sheet. Namely, for example, if the oblique sheets and the axial sheet have a thickness of 0.1 mm, the combined thickness of the oblique sheets are 0.2 mm since the two oblique sheets are superposed together, and this thickness is twice larger than the thickness of the axial sheet. Therefore, when such thick sheet is wound, an uneven thickness condition due to this thickness develops at an overlapping portion at a winding-end region.

Particularly recently, shafts have been required to have a lightweight, high-elasticity design, and the number of winding of oblique sheets and axial sheets has been reduced. Therefore, if an uneven thickness condition due to the above-mentioned thickness difference develops at the end region of the wound sheets, there is encountered a problem that this causes the reduction of the strength, or the unevenness of the strength increases.

Usually, the shaft has a larger diameter at a grip side, and has a smaller diameter at a head side, and therefore a torsional rigidity is larger at the grip side, and is smaller at the head side. Therefore, the number of winding of the oblique sheets at the head side is different from that at the grip side so that the oblique fiber layer can have a larger thickness at the head side, and can have a smaller thickness at the grip side.

With this construction, however, there is encountered a problem that the strength is liable to be reduced at a generally-central portion of the shaft by a torsion and a load of the head, so that the shaft is liable to be broken or damaged.

SUMMARY OF THE INVENTION

It is an object of this invention to provide a golf club shaft which is prevented from being reduced in strength and also from having an uneven strength.

In order to achieve the above object, according to the invention, there is provided a golf club shaft formed by winding prepreg sheets one on another, each of the prepreg sheets having reinforcing fibers oriented in one direction and impregnated with synthetic resin, the golf club shaft including:

an oblique fiber layer formed from at least two adjacent ones of the prepreg sheets, wherein the two adjacent prepreg sheets are mutually arranged so that the reinforcing fibers in one of the two adjacent prepreg sheets intersect the reinforcing fibers in the other of the two adjacent prepreg sheets, wherein the two adjacent prepreg sheets are wound about an axis so that the reinforcing fibers in the two adjacent prepreg sheets are obliquely arranged with respect to the axis, and wherein each of the two adjacent prepreg sheets has a thickness equal to or less than 0.06 mm.

The thickness of conventional prepreg sheets, wound on the shaft, was about 0.1 mm to about 0.2 mm, and in this invention, the thickness of each of the prepreg sheets of the oblique fiber layer is not more than 0.06 mm, and therefore the thickness of the oblique fiber layer, formed by superposing these prepreg sheets, is about 0.1 mm to about 0.2 mm, and the thickness difference at an overlapping portion at a winding-end region can be reduced, and the reduction of the strength and the unevenness of the strength are suppressed.

According to the invention, there is provided a golf club shaft formed by winding prepreg sheets one on another, each of the prepreg sheets having reinforcing fibers oriented in one direction and impregnated with synthetic resin, the golf club shaft including:

an oblique fiber layer formed from at least two adjacent ones of the prepreg sheets, wherein the two adjacent prepreg sheets are mutually arranged so that the reinforcing fibers in one of the two adjacent prepreg sheets intersect the reinforcing fibers in the other of the two adjacent prepreg sheets, wherein the two adjacent prepreg sheets are wound about an axis so that the reinforcing fibers in the two adjacent prepreg sheets are obliquely arranged with respect to the axis, wherein the number of winding of the oblique prepreg sheets at a distal end portion of the shaft is different from that at a proximal end portion of the shaft, and wherein the each of prepreg sheets is wound in not less than 2 plies (i.e., two superimposed layers) in the arranged direction of the fibers at that region of the shaft ranging between 40% and 60% of an overall shaft length from the distal end thereof.

Usually, the shaft is liable to be broken by torsion and a load of a head at that region ranging between 40% and 60% of the overall shaft length from the distal end thereof. The thickness of the oblique fiber layer is increased at this region, thereby enhancing the strength, and also suppressing such breakage.

According to the invention, there is provided a golf club shaft formed by winding prepreg sheets one on another, each of the prepreg sheets having reinforcing fibers oriented in one direction and impregnated with synthetic resin, the golf club shaft including:

an oblique fiber layer formed from at least two superposed prepreg sheets, wherein the superposed prepreg sheets are formed by the two adjacent prepreg sheets so that one of the adjacent prepreg sheets superposes on another, wherein the superposed prepreg sheets are arranged so that the reinforcing fibers in one of the two adjacent prepreg sheets and the reinforcing fibers in the other of the two adjacent prepreg sheets almost cross at right angles, wherein the superposed prepreg sheets are wound about an axis so that the reinforcing fibers in the two adjacent prepreg sheets are obliquely arranged with respect to the axis, and wherein the superposed prepreg sheets are wound in such a manner that winding-initial positions of prepreg sheets are displaced with respect to each other in a peripheral or circumstantial direction.

When the oblique fiber layer is formed by at least two superposition prepreg sheets, their winding-starting positions are displaced with respect to each other in the peripheral direction, and with this construction the development of an uneven thickness condition due to the thickness difference, developing at the winding-end portion, is suppressed, and the reduction and unevenness of the strength are suppressed.

A golf club shaft formed by winding prepreg sheets one on another, each of said prepreg sheets having reinforcing fibers oriented in one direction and impregnated with synthetic resin, the golf club shaft including:

an oblique fiber layer formed from at least two superposed prepreg sheets, wherein said superposed prepreg sheets are formed by the two adjacent prepreg sheets so that one of the said adjacent prepreg sheets superposes on another, wherein said superposed prepreg sheets are arranged so that the reinforcing fibers in one of said two said adjacent prepreg sheets and the reinforcing fibers in the other of said two adjacent prepreg sheets almost cross at right angles, wherein said oblique fiber layer has a thickness equal to or less than 0.1 mm, and wherein the amount of the impregnated resin in said oblique fiber layer is equal to or less than 35 wt. %.

The thickness of the oblique fiber layer is not more than 0.1 mm, and the amount of the impregnated resin is not more than 35 wt. %, and with this construction, the breakage of the shaft is prevented, so that the golf club of a high strength can be provided, and also, there can be obtained the golf club in which the unevenness of the strength is reduced, and the stabilized strength is achieved. By winding the superposition prepreg sheet which is reduced in thickness by reducing the amount of the impregnated resin, the specific strength and the specific torque can be enhanced, and also the lightweight design can be achieved.

According to the invention, there is provided a golf club shaft formed by winding prepreg sheets one on another, each of the prepreg sheets having reinforcing fibers oriented in one direction and impregnated with synthetic resin, the golf club shaft including:

an axis fiber layer formed from the prepreg sheets and an oblique fiber layer formed from at least two adjacent ones of the prepreg sheets, wherein the axis fiber layer is formed so that prepreg sheets are wound about an axis so that the reinforcing fibers in the prepreg sheets are arranged in parallel with respect to the axis, wherein the oblique fiber layer is formed so that the oblique fiber layer is formed so that the two adjacent prepreg sheets are mutually arranged so that the reinforcing fibers in one of the two adjacent prepreg sheets intersect the reinforcing fibers in the other of the two adjacent prepreg sheets, wherein the oblique fiber layer is formed so that the two adjacent prepreg sheets are wound about an axis so that the reinforcing fibers in said two adjacent prepreg sheets are obliquely arranged with respect to the axis and wherein the oblique fiber layer is formed so that the amount of the impregnated resin in the oblique fiber layer is equal to or less than 30 wt. % and the thickness of the oblique fiber layer is equal to or less than 0.05 mm.

And, there is provided a golf club shaft formed by winding prepreg sheets one on another, each of the prepreg sheets having reinforcing fibers oriented in one direction and impregnated with synthetic resin, the golf club shaft including:

an axis fiber layer formed from the prepreg sheets, an oblique fiber layer formed from at least two adjacent ones of the prepreg sheets, and a peripheral fiber layer formed from the prepreg sheets, wherein the axis fiber layer is formed so that prepreg sheets are wound about an axis so that the reinforcing fibers in the prepreg sheets are arranged in parallel with respect to the axis, wherein the oblique fiber layer is formed so that the two adjacent prepreg sheets are mutually arranged so that the reinforcing fibers in one of the two adjacent prepreg sheets intersect the reinforcing fibers in the other of the two adjacent prepreg sheets, wherein the oblique fiber layer is formed so that the two adjacent prepreg sheets are wound about an axis so that the reinforcing fibers in said two adjacent prepreg sheets are obliquely arranged with respect to the axis and wherein the peripheral fiber layer is formed so that prepreg sheets are wound about an axis so that the reinforcing fibers in the prepreg sheets are arranged perpendicularly with respect to the axis, wherein at least one of the oblique fiber layer and the peripheral fiber layer is formed so that the amount of the impregnated resin in the fiber layer is equal to or less than 30 wt. % and the thickness of the fiber layer is equal to or less than 0.05 mm.

With respect to at least one of the oblique fiber layer and the peripheral fiber layer, the amount of the impregnated resin is not more than 30 wt. %, and a thickness thereof is not more than 0.05 mm, and with this construction, the breakage of the shaft is prevented, so that the golf club of a high strength can be provided, and also, there can be obtained the golf club in which the unevenness of the strength is reduced, and the stabilized strength is achieved. And besides, the uneven thickness and the directional property are prevented, and also the specific strength and the specific torque can be enhanced, and the lightweight design can be achieved.

DETAILED DESCRIPTION OF THE PREFERRED EMBODIMENTS

A preferred embodiment of the present invention will now be described with reference to the accompanying drawings.

Figure 1:
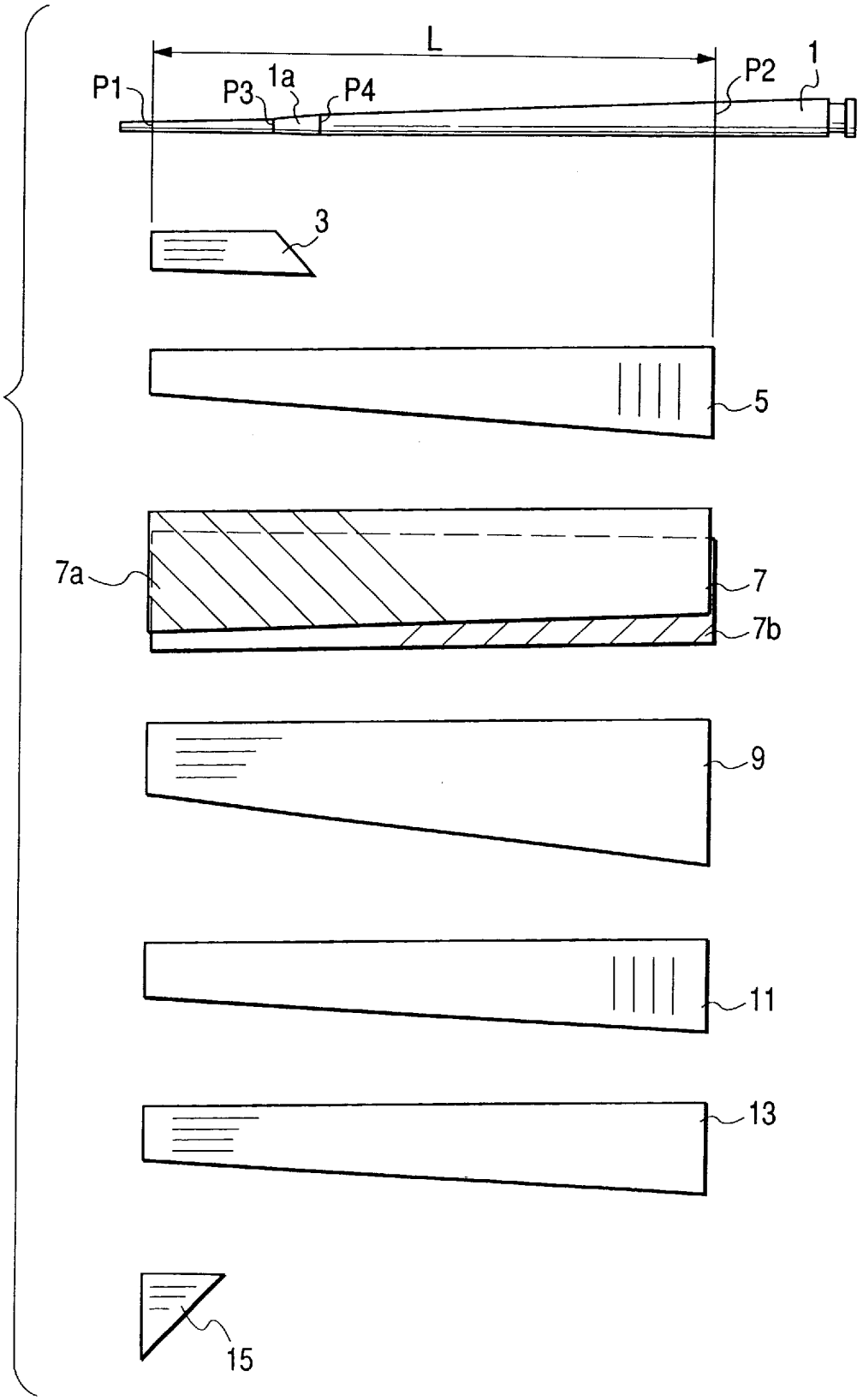
FIG. 1 is a view of a first embodiment of the present invention, showing one example of arrangement of prepreg sheets to be wound on a metal core.

FIG. 1 is a view showing one example of arrangement of prepreg sheets to be wound on a metal core 1 so as to form a shaft. In this case, the prepreg sheets, described below, are wound on the metal core 1 over a region L (=116 mm). A diameter of a front (distal) end portion P1 of the metal core 1 (front end of the shaft) is 5.0 mm, and a diameter of its rear (proximal) end portion P2 (rear end of the shaft) is 14.9 mm, and a diameter of a portion (position) P3, spaced 150 mm from the distal end portion P1, is 6.2 mm, and a diameter of a portion (position) P4, spaced 80 mm from the portion P3, is 7.2 mm. That portion of the metal core 1, lying between the portion P3 and the portion P4, is steeply tapering as at 1*a*. The steeply-tapering portion 1*a* is thus formed at the distal end region of the metal core 1, and with this construction the distal end region of the shaft to be formed has a sufficient strength, and has a smooth rigidity distribution.

The prepreg sheet 3, serving as a reinforcing layer at the distal end region, is wound on the metal core 1, and then the prepreg sheets 5, 7, 9, 11 and 13, jointly constituting a body layer forming the whole of the shaft, are sequentially wound on the metal core 1. Then, the prepreg sheet 15, serving as a reinforcing layer at the distal end region, is wound on the body layer. Each of the prepreg sheets is formed by arranging or orienting carbon fibers in one direction and then by impregnating these fibers with a thermosetting synthetic resin such as an epoxy resin, a urethane resin and an acrylic resin, and these prepreg sheets have the following constructions, respectively.

The prepreg sheet 3, serving as the reinforcing layer at the distal end region, comprises the carbon fibers (having an elastic modulus of 24 tonf/mm$^2$) oriented in the axial direction, and the amount of the impregnated resin is 30 wt. %, and the amount of the fibers is 125 g/m$^2$, and the thickness is 0.114 mm. This prepreg sheet 3 is cut into such a size that it can be wound in 3 (triple) plies on the metal core 1 at its opposite axial ends. This prepreg sheet 3 may be backed with a woven cloth of glass.

The prepreg sheet 5, which is the uppermost layer of the body layer, comprises the carbon fibers (having an elastic modulus of 40 tonf/mm$^2$) oriented in the peripheral (circumferential) direction, and the amount of the impregnated resin is 40 wt. %, and the amount of the fibers is 28 g/m$^2$, and the thickness is 0.032 mm. This prepreg sheet 5 is cut into such a size that it can be wound in 1.1 plies on the metal core 1 at its opposite axial ends.

The prepreg sheet 7 is wound on the prepreg sheet 5, and this prepreg sheet 7 is constituted by prepreg sheets 7*a* and 7*b* (each having the carbon fibers (having an elastic modulus of 40 tonf/mm$^2$) oriented in a direction oblique relative to the axial direction) superposed together in such a manner that the directions of orientation of the carbon fibers of the two sheets 7*a* and 7*b* cross or intersect each other (preferably at angles of ±45° relative to the axial direction). With respect to each of the prepreg sheets 7*a* and 7*b*, the amount of the impregnated resin is less than 30 wt. %, and preferably in the range of between 10 wt. % and 25 wt. %, and the amount of the fibers is 58 g/m$^2$, and the thickness is 0.048 mm. In this case, the thickness should be not more than 0.06 mm, and is preferably 0.048 mm (as in this example) or less. Each of the prepreg sheets 7*a* and 7*b* is cut into such a size that it is can be wound in 4 plies (that is, 8 plies in the superposed condition) at the distal end, and can be wound in 1.6 plies (that is, 3.2 plies in the superposed condition) at the proximal end. The expression "1.6 plies" as used herein refers to a layer that is superimposed onto itself by an amount of 60% of its own surface area. In other words, 1.5 plies would refer to a layer that is wrapped 1½ times, thereby overlapping itself by one-half or 50%. If prepreg sheets 7*a*, 7*b* are first superimposed upon themselves, then wrapped by 3 turns, the result would be an arrangement equaling 4 plies in the superimposed condition. Preferably, the two prepreg sheets 7*a* and 7*b* are superposed together in such a manner that they are displaced with respect to each other in the peripheral direction, as shown in the drawings. In this construction, each of the prepreg sheets 7*a* and 7*b* is wound in at least 2 plies (that is, 4 plies altogether in the superposed condition) at its intermediate region.

The prepreg sheet 9, which is wound on the prepreg sheet 7, comprises the carbon fibers (having an elastic modulus of 30 tonf/mm$^2$) oriented in the axial direction, and the amount of the impregnated resin is 30 wt. %, and the amount of the fibers is 150 g/m$^2$, and the thickness is 0.137 mm. This prepreg sheet 9 is cut into such a size that it can be wound in 2 plies on the metal core 1 at its opposite axial ends.

The prepreg sheet 11, which is wound on the prepreg sheet 9, has the same construction as that of the prepreg sheet 5, and is cut into such a size that it can be wound in 1.1 plies on the metal core 1 at its opposite axial ends. The prepreg sheet 13, which is wound on the prepreg sheet 11, comprises the carbon fibers (having an elastic modulus of 24 tonf/mm$^2$) oriented in the axial direction, and the amount of the impregnated resin is 30 wt. %, and the amount of the fibers is 125 g/m$^2$, and the thickness is 0.114 mm. This prepreg sheet 13 is cut into such a size that it can be wound in 1 ply on the metal core 1 at its opposite axial ends.

The prepreg sheet 15, serving as the reinforcing layer at the distal end region, is wound on the prepreg sheet 13. This prepreg sheet 15 has the same construction as that of the prepreg sheet 3 serving as the innermost reinforcing layer, and is cut into such a size that it can be wound in 3 plies on the distal end portion of the metal core, and can be 0 (zero) ply at the position P3.

The prepreg sheets of the above constructions may be wound one by one on the metal core 1, or two or more of these prepreg sheets may be beforehand bonded together to form a laminated sheet which is then wound on the metal core 1. For example, the prepreg sheet 5 may be beforehand bonded to the prepreg sheet 7, and the prepreg sheet 11 may be beforehand bonded to the prepreg sheet 13. Although the prepreg sheet 7 comprises the prepreg sheets 7*a* and 7*b* which are beforehand bonded together, the prepreg sheets 7*a* and 7*b* may not be beforehand bonded together, but may be wound separately on the metal core 1.

As described above, each of the prepreg sheets 7*a* and 7*b*, jointly constituting an oblique fiber layer, has the thickness of 0.048 mm, and the combined thickness of the superposed sheets 7*a* and 7*b* are not more than 0.1 mm, and are smaller than the thickness of the prepreg sheet 9 and the thickness of the prepreg sheet 13. Therefore, the prepreg sheet 7 is hardly different in thickness from the prepreg sheets 9 and 13, and when these sheets are wound, the development of an uneven thickness condition due to this thickness difference is suppressed at an overlapping portion at a winding-end region thereof, and the reduction and unevenness of the strength of the finished shaft are suppressed. In order that such effects can b e efficiently obtained, it is preferred that the thickness of each of the prepreg sheets 7*a* and 7*a,* jointly constituting the oblique fiber layer, should be not more than about a half of the thickness of the prepreg sheets 9 and 13.

The prepreg sheet 7 may be formed by superposing the prepreg sheets 7*a* and 7*b* accurately in registration with each other (that is, in such a manner that they accurately coincide with each other). However, when the prepreg sheets 7*a* and 7*b* are superposed together in such a manner that they are displaced with respect to each other in a direction perpendicular to the axial direction as shown in the drawings, a thickness change, developing at the winding-end region when the sheet 7 is wound on the metal core 1, can be more effectively suppressed. Further, when the amount of the impregnated resin in each of the prepreg sheets 7*a* and 7*b,* jointly constituting the oblique fiber layer, is less than 30 wt. %, and preferably not more than 25 wt. %, a lightweight, high-strength design of the shaft can be achieved. In this case, in order to secure a sufficient strength between the layers, its lower limit should be 10 wt. %.

As in the above construction, preferably, the prepreg sheets 5 and 11, which have the carbon fibers oriented in the peripheral direction, and have a smaller thickness of 0.032 mm as compared with the other prepreg sheets of the body layer, are interposed. By thus providing the peripheral fiber layers of a small thickness, the carbon fibers of their adjoining prepreg sheets can be fixed against movement, and also the overall crushing strength of the shaft can be enhanced.

Figure 2:
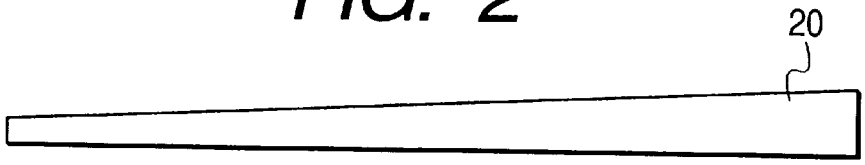
FIG. 2 is a view showing a shaft formed by the arrangement of the prepreg sheets shown in FIG. 1.
Figure 3:
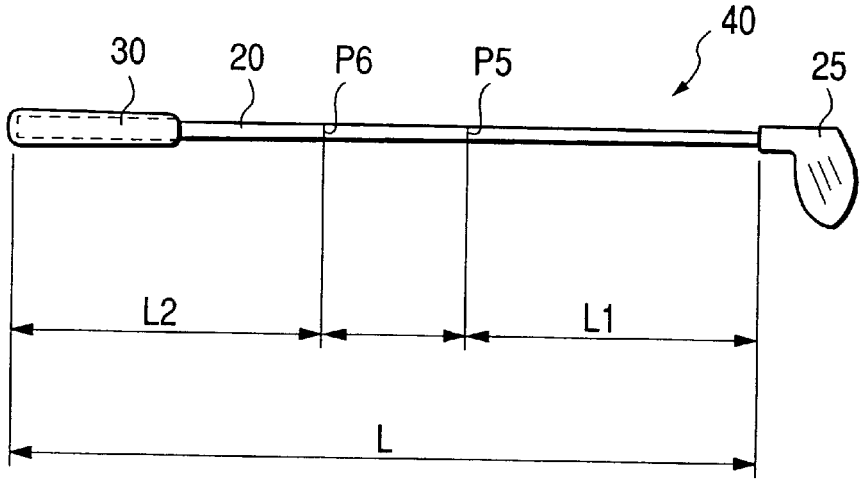
FIG. 3 is a golf club formed by mounting a head and a grip on the shaft of FIG. 2.

The prepreg sheets of the above constructions are wound on the metal core 1, and then the shaft 20 as shown in FIG. 2 is formed through an ordinary process or method including a heating step, a cooling step, a core-removing step, a polishing step and a coating step. A club head 25 as shown in FIG. 3 is fitted on the distal end portion of the thus formed shaft 20, and a grip 30 is fitted on the proximal end portion of the shaft 20, thereby completing a golf club 40.

Figure 4:
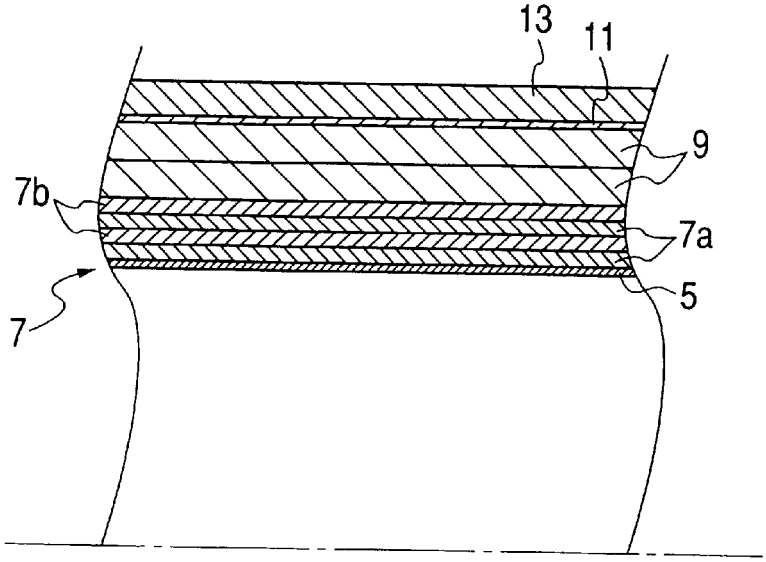
FIG. 4 is a view showing a cross-sectional structure of a generally-central portion of the shaft.

When the prepreg sheets of the above constructions (particularly, the prepreg sheets 7*a* and 7*b* each cut into such a size that it is can be wound in 4 plies at the distal end portion, and can be wound in 1.6 plies at the proximal end portion), are wound, the cross-sectional structure of that portion or region of the shaft ranging between 40% and 60% of the overall shaft length (L=1160 mm) from the distal end thereof (that is, between a position P5 (L1=464 mm) and a position P6 (L2=464 mm)) is such that each of the prepreg sheets 7*a* and 7*b* is wound in at least 2 plies, thus providing an increased thickness, as shown in FIG. 4.

Figure 6:
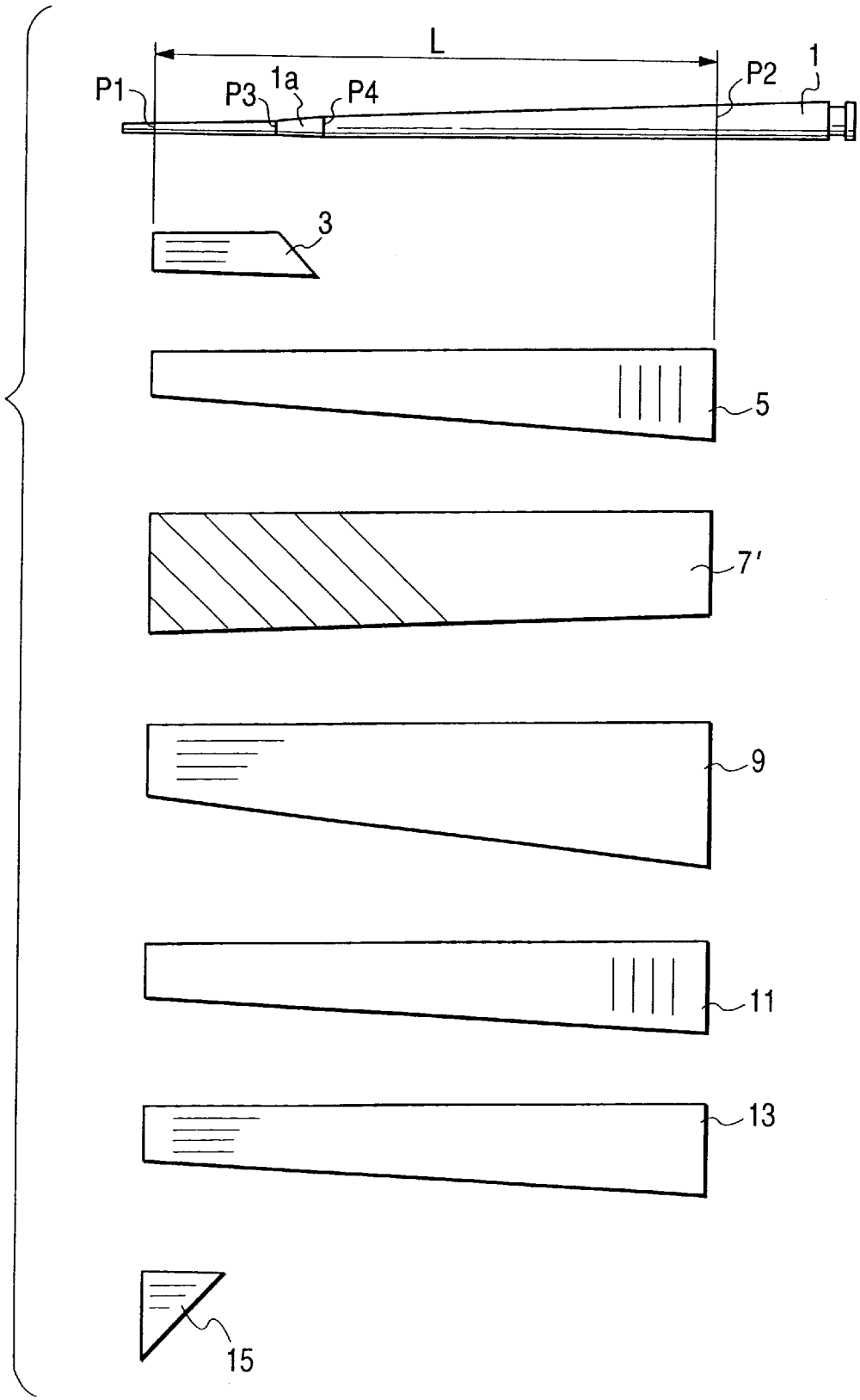
FIG. 6 shows a another embodiment of the invention, FIG. 6 being a view showing one example of arrangement of prepreg sheets to be wound on a metal core, wherein the obliqre fiber layer is formed from one oblique prepreg sheet.

Only one oblique prepreg sheet may be wound on the prepreg sheet 5. In FIG. 6, a prepreg sheet 7' having a characteristics as same as said prepreg sheet 7*a* and 7*b,* cut into such a size that it is can be wound in 8 plies at the distal end portion, and can be wound in 3.2 piles at the proximal end portion, are wound, the cross-sectional structure of that portion or region of the shaft ranging between 40% and 60% of the overall shaft length (L=1160 mm) from the distal end thereof (that is, between a position P5 (L1=464 mm) and a position P6 (L2=464 mm)) is such that each of the prepreg sheet 7' is wound in at least 4 plies, thus providing an increased thickness, as shown in FIG. 6.

As described above, the shaft of the golf club is liable to be broken or damaged by a torsion and the load of the head at that region ranging between 40% and 60% of the overall shaft length from the distal end thereof. However, the oblique fiber layer has an increased thickness at this region as shown in the drawings, and therefore the strength is increased, and the breakage is suppressed. Shafts, obtained by the arrangement of prepreg sheets as shown in FIG. 1, were actually tested for comparison purposes. The shaft of the invention included a prepreg sheet 7 having a construction (A) of this embodiment as shown in Table 1 below, and the comparative shaft included a corresponding prepreg sheet 7 of a conventional construction (B). In this case, the shaft of the invention and the comparative shaft were the same with respect to other prepreg sheets than the prepreg sheet 7 (prepreg sheets 7*a* and 7*b*), and were identical in shaft weight and thickness to each other.

TABLE 1

| | A | B |
|---|---|---|
| Elastic modulus | 40 tonf/mm$^2$ | 40 tonf/mm$^2$ |
| Amount of impregnated resin | 25 wt. % | 25 wt. % |
| Amount of fibers | 58 g/m$^2$ | 116 g/m$^2$ |
| Thickness of sheet | 0.048 mm | 0.096 mm |
| Number of winding | | |
| Distal end | 4 plies for each sheet | 2 plies for each sheet |
| Proximal end | 1.6 plies for each sheet | 0.8 plies for each sheet |

The shaft, having the construction (A), was 21% higher in torsional strength than the shaft having the conventional construction (B), and was not uneven in strength, and the strength was stabilized and enhanced. A torque for the shaft, having the construction (A), was 6.6 degrees, and was smaller by an amount of 0.4 degrees (5.7%) than a torque (7.0 degrees) for the shaft having the construction (B). And besides, because of the stabilization and enhancement of the strength, the shaft of a lightweight design was achieved, and there could be obtained the golf club which could be easily swung.

Figure 5A:
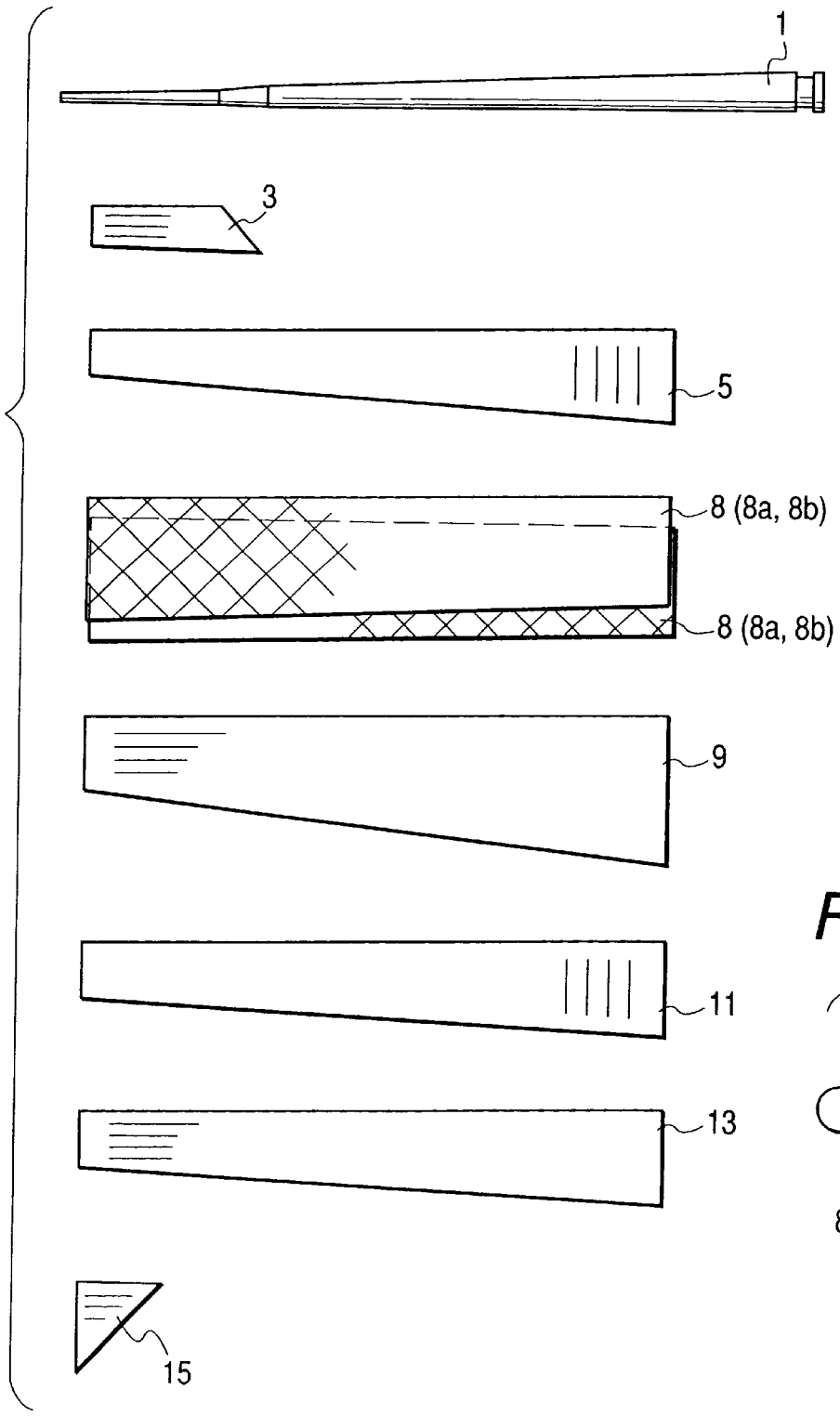
FIG. 5 shows a second embodiment of the invention, FIG. 5A being a view showing one example of arrangement of prepreg sheets to be wound on a metal core, and FIG. 5B being a view showing prepreg sheets of an oblique fiber layer in their superposed condition.

Next, another embodiment of the present invention will be described with reference to FIGS. 5A and 5B. A metal core 1 and prepreg sheets 3, 5, 9, 11 and 13, used in this embodiment, are identical in construction to those of the above first embodiment, respectively, and therefore explanation thereof will be omitted.

This embodiment is characterized in prepreg sheets constituting an oblique fiber layer. More specifically, the oblique fiber layer comprises at least two superposition prepreg sheets 8 each constituted by prepreg sheets 8*a* and 8*b* (each having reinforcing fibers oriented in a direction oblique relative to the axis of the shaft (preferably at an angle of 45° relative to the axial direction)) superposed together in such a manner that the directions of orientation of the fibers of the two sheets 8*a* and 8*b* are generally perpendicular to each other.

With respect to each of the prepreg sheets 8*a* and 8*b,* the amount of impregnated resin is less than 30 wt. %, and preferably in the range of between 10 wt. % and 25 wt. %, and the amount of the fibers is 29 g/m$^2$, and the thickness is 0.024 mm. Namely, the prepreg sheet 8, formed by the prepreg sheets 8*a* and 8*b* superposed together, has a thickness of 0.048 mm, and therefore has the same thickness and the same amount of the fibers as those of each of the prepreg sheets 7*a* and 7*b* of the first embodiment. Each of the prepreg sheets 8*a* and 8*b,* jointly constituting the superposition prepreg sheet 8, is cut into such a size that it is can be wound in 4 plies (that is, 8 plies in the superposed condition) at the distal end, and can be wound in 1.6 plies (that is, 3.2 plies in the superposed condition) at the proximal end. Therefore, when the two superposition prepreg sheets 8 are wound in a superposed manner, these sheets are 16 plies at the distal end, and 6.4 plies at the proximal end, and each prepreg sheet 8 is at least 2 plies (that is, 4 plies for the two superposition prepreg sheets) at an intermediate region.

Figure 5B:
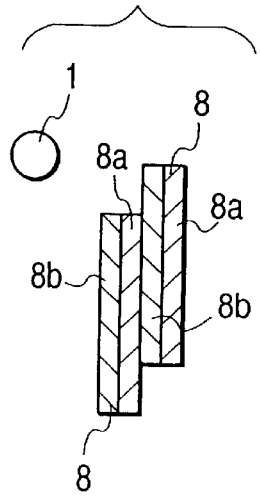

As shown in FIG. 5B, the two superposition prepreg sheets 8 are superposed together in such a manner that their winding-starting positions are displaced with respect to each other in the direction of the periphery (circumference) of the metal core 1. Namely, by thus displacing the winding-starting positions of the two superposition prepreg sheets 8 with respect to each other in the direction of the periphery of the metal core 1, the development of an uneven thickness condition due to the thickness difference is suppressed at an overlapping portion at a winding-end region thereof, and as a result the reduction and unevenness of the strength of the finished shaft are suppressed as in the first embodiment. In this embodiment, the oblique fiber layer is formed by at least two superposition prepreg sheets 8 superposed together and wound in a predetermined number of plies, each of the prepreg sheets 8 being formed by the prepreg sheets 8*a* and 8*b* (the amount of the fibers: 29 g/m$^2$) having the thickness of 0.024 mm, and with this construction, particularly the enhancement of the torsional strength and the stabilization of the strength can be achieved.

In the construction shown in FIG. 5, only one of the two superposition prepreg sheets 8 and 8 may be used, in which case its width is increased accordingly so that the number of winding of this sheet can be increased. In this case, the oblique fiber layer is formed by this prepreg sheet wound in not less than 1 ply (usually, 2 to 6 plies). In this case, the thickness of the oblique fiber layer, formed by the superposition prepreg sheet, is not more than 0.1 mm, and preferably is not more 0.07 mm so that the enhancement of the specific strength and specific torque, as well as a more lightweight design, can be achieved, and more preferably this thickness is not more than 0.04 mm. The amount of the impregnated resin in this superposition prepreg sheet is not more than 35 wt. %, and preferably is not more than 30 wt. % so that the enhancement of the specific strength and specific torque, as well as a more lightweight design, can be achieved, and more preferably this amount is not more than 25 wt. %. Prepreg sheets 3, 5, 9, 11, 13 and 15, constituting other layers than the oblique fiber layer, are the same as those of the embodiment of FIG. 5, but the winding positions and the number of plies can be suitably determined.

In the embodiments, the prepreg sheets, constituting the oblique fiber layer, or the oblique fiber layer and the peripheral fiber layers, or the peripheral fiber layers, are preferably constructed as follows so that the prevention of breakage and the uneven strength, the stabilized strength, the prevention of the uneven thickness and the directional property, the enhancement of the specific strength and the specific torque, the lightweight design, and so on can be effectively achieved. Namely, the amount of the impregnated resin is not more than 30 wt. %, and preferably not more than 25 wt. %, and more preferably in the range of between 10 wt. % and 25 wt. %, and the thickness is not more than 0.06 mm, and preferably not more than 0.04 mm, and more preferably 0.035 mm to 0.005 mm, and the amount of the fibers is not more than 40 g/m$^2$, and preferably not more than 35 g/m$^2$, and more preferably 10 g/m$^2$ to 35 g/m$^2$. The axial fiber layer is formed by winding the prepreg sheet having a thickness equal to or larger than the thickness of the above prepreg sheets. By using these prepreg sheets, the bending rigidity can be effectively enhanced, and the shaping operation can be carried out easily. With respect to the number of winding of the prepreg sheets, the directional property and the uneven thickness can be prevented with an integral winding number rather than with a non-integral winding number. The winding positions of the prepreg sheets and the winding numbers thereof may be suitably determined.

The prepreg sheet 11, shown in FIG. 1 and 6, may be replaced by an oblique prepreg sheet. This oblique sheet may comprise one prepreg sheet having fibers oriented only in one direction, or may comprises two prepreg sheets superposed together in such a manner that their winding-starting positions are displaced with respect to each other in the peripheral direction so that the directions of orientation of the fibers of the two sheets cross or intersect each other. The prepreg sheet 11 may comprise an oblique superposition prepreg sheet. In this case, the thickness of an oblique fiber layer, formed by such a prepreg sheet, is not more than 0.1 mm, and preferably not more than 0.07 mm, and more preferably not more than 0.04 mm. The prepreg sheet 11 may be wound to form an innermost layer or an outermost layer, or may be disposed between the prepreg sheets 3 and 5, or between the prepreg sheets 5 and 7, or between the prepreg sheets 7 and 9. However, in view of the enhancement of the torque and so on, it is preferred that the prepreg sheet 11 be disposed outwardly of the prepreg sheet 9. When the axial length of the layer, formed by the wound prepreg sheet 11, is 200 mm to 500 mm measured from the distal end (having a smaller diameter) of the shaft, the torque of the shaft can be effectively reduced. However, the provision of the prepreg sheet 11 is not limited to this region, but the prepreg sheet 11 may be wound over a longer region, and may be wound over the entire length of the shaft, or only over an intermediate portion of the shaft, or a proximal end portion of the shaft (for example, a grip portion). There may be used an arrangement in which an oblique prepreg sheet is wound at the distal end portion while a peripheral prepreg sheet is wound at the proximal end portion (The oblique prepreg sheet and the peripheral prepreg sheet are provided separately in the axial direction). In this case, the lengths and arrangements of the prepreg sheets can be suitably adjusted.

In the case where the prepreg sheet 11 is formed by an oblique prepreg sheet, and is wound outwardly of the oblique prepreg sheet 7, the amount of a shearing strain, acting on the prepreg sheet 11 upon application of a torsional load, is larger than that acting on the oblique prepreg sheet 7. Therefore, preferably, the oblique prepreg sheet 11 is formed by the reinforcing fibers having a higher breaking extension degree than that of the reinforcing fibers of the oblique prepreg sheet 7, or the reinforcing fibers of the prepreg sheet 11 are oriented in such a direction that these fibers will not be broken even if a large breaking extension force is applied. Preferably, the reinforcing fibers, used in the oblique prepreg sheet 11, have the breaking extension degree not more than 5% (preferably, not more than 10%) larger than that of the reinforcing fibers used in the oblique prepreg sheet 7. With this construction, the torsional strength is enhanced.

Generally, however, those materials, having a high breaking extension degree, have a low elastic modulus, and therefore it is preferred to decrease the amount of the impregnated resin (that is, increase the content of the fibers) in order to increase the specific elasticity. The amount of the impregnated resin is not more than 35 wt. %, and preferably not more than 30 wt. %, and more preferably 10 wt. % to 25 wt. %. With this construction, the torsional rigidity can be enhanced. As described above, the thickness of the prepreg sheet is not more than 0.06 mm, and preferably not more than 0.04 mm, and more preferably 0.035 mm to 0.005 mm.

Although the embodiments of the present invention have been described above, the invention is not limited to the above embodiments, but various modifications can be made. For example, carbon fibers are used as the reinforcing fibers of the prepreg sheets, but other organic and inorganic fibers, such as glass, boron, aramid and alumina, can be used. As described above, the present invention is characterized in the specific construction of the prepreg sheet (sheets), constituting the oblique fiber layer, and the features of this specific construction are that the thickness of the prepreg sheet, constituting the oblique fiber layer, is smaller than the thickness of the prepreg sheet constituting the axial fiber layer, that the thickness of the oblique fiber layer is increased (each of the prepreg sheets is wound in at least 2 plies in the direction of orientation of the fibers) at the generally central portion of the shaft, and that the prepreg sheets, constituting the oblique fiber layer, are superposed together in such a manner that their winding-starting positions are displaced with respect to each other. Therefore, with respect to the other prepreg sheets, the elastic modulus of the reinforcing fibers, the amount of the impregnated resin, the amount of the fibers, the thickness and the number of the plies have been described merely by way of examples, and the specific constructions of these prepreg sheets, described in the above embodiments, can be suitably varied in accordance with the number of the golf club and required characteristics. For example, although the auxiliary prepreg sheets 3 and 15, provided for partially-reinforcing purposes, have the fibers oriented in the axial direction, these fibers may be oriented in a slanting direction intersecting the axial direction, or may be oriented in the peripheral direction, or the fibers, oriented in these directions, may be used in combination with each other, in which case the prepreg sheet is preferably smaller in thickness than the prepreg sheets 7, 9 and 13 constituting the body layer.

In the present invention, the breakage of the shaft is prevented, so that the golf club of a high strength can be provided, and also, there can be obtained the golf club in which the unevenness of the strength is reduced, and the stabilized strength is achieved.

What is claimed is:

1. A golf club shaft formed by winding prepreg sheets one on another, each of said prepreg sheets having reinforcing fibers oriented in one direction and impregnated with synthetic resin, said golf club shaft comprising:

an oblique fiber layer formed from at least two superposed prepreg sheets, wherein each of said superposed prepreg sheets are each formed by two adjacent prepreg sheets so that one of said adjacent prepreg sheets superposes on another, wherein said superposed prepreg sheets are arranged so that the reinforcing fibers in one of said two adjacent prepreg sheets and the reinforcing fibers in the other of said two adjacent prepreg sheets almost cross at right angles, wherein said superposed prepreg sheets are wound about an axis so that the reinforcing fibers in said two adjacent prepreg sheets are obliquely arranged with respect to said axis, and wherein said superposed prepreg sheets are wound in such a manner that winding-initial positions of said superposed prepreg sheets are displaced with respect to each other in a peripheral or circumstantial direction.

2. The golf club shaft as recited in claim 1, wherein the two adjacent prepreg sheets in each of the superposed prepreg sheets have the same thickness.

3. The golf club shaft as recited in claim 1, wherein the two adjacent prepreg sheets in each of the superposed prepreg sheets have a thickness of equal to or less than 0.024 mm.

4. The golf club shaft according to claim 1, wherein said oblique layers have a resin impregnation percentage less than 30% by weight.

5. The golf club shaft according to claim 4 wherein said oblique layers have an impregnation percentage between 10–25% by weight.

* * * * *